US011052674B2

(12) United States Patent
Nohara et al.

(10) Patent No.: US 11,052,674 B2
(45) Date of Patent: Jul. 6, 2021

(54) EXHAUST DEVICE FOR INKJET COATING, INKJET EJECTION DEVICE, INKJET COATING METHOD, AND METHOD FOR MANUFACTURING MEMBER

(71) Applicant: MITSUBISHI HEAVY INDUSTRIES, LTD., Tokyo (JP)

(72) Inventors: Toshikatsu Nohara, Tokyo (JP); Masaki Kimura, Tokyo (JP); Kosuke Ikeda, Tokyo (JP); Yoshinao Komatsu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/786,262

(22) Filed: Feb. 10, 2020

(65) Prior Publication Data

US 2020/0254798 A1 Aug. 13, 2020

(30) Foreign Application Priority Data

Feb. 12, 2019 (JP) ..... JP2019-022205

(51) Int. Cl.
*B41J 2/01* (2006.01)
*B41J 29/377* (2006.01)
(Continued)

(52) U.S. Cl.
CPC ..... *B41J 3/4073* (2013.01); *B05B 1/3046* (2013.01); *B05B 12/18* (2018.02);
(Continued)

(58) Field of Classification Search
CPC ..... B41J 2/01; B41J 3/4073; B41J 29/377; B05B 1/3046; B05B 12/00; B05B 12/18;
(Continued)

(56) References Cited

U.S. PATENT DOCUMENTS 5,296,873 A * 3/1994 Russell ..... B41J 2/1714 101/424.1
5,406,316 A * 4/1995 Schwiebert ..... B41J 11/002 346/25

(Continued)

FOREIGN PATENT DOCUMENTS

CN 1128716 C 11/2003
EP 2100744 A1 9/2009

(Continued)

OTHER PUBLICATIONS

Office Action issued in corresponding European Patent Application No. 20156453.1, dated Feb. 8, 2021 (5 pages).

*Primary Examiner* — Anh T Vo
(74) *Attorney, Agent, or Firm* — Osha Bergman Watanabe & Burton LLP

(57) ABSTRACT

To reduce an influence of a flow of ambient atmosphere and the like on flying of a droplet ejected from a nozzle of an inkjet head. To exhaust vapor of a solvent contained in a coated film while reducing an influence on flying of the droplet. An exhaust device for inkjet coating includes: a cover that covers at least a target range on an object to be coated, the target range being a range in which a droplet lands that is ejected from an ejection nozzle of an inkjet head to a surface of the object to be coated; a closing member that closes a gap between the cover and the object to be coated around the target range; an external communication portion through which a compartment surrounded by the cover, the object to be coated, and the closing member communicates with an outside; and an exhaust mechanism configured to exhaust air from the compartment.

14 Claims, 14 Drawing Sheets

(51) Int. Cl.

| | |
|---|---|
| ***B41J 3/407*** | (2006.01) |
| ***B05B 13/04*** | (2006.01) |
| ***B05B 14/49*** | (2018.01) |
| ***B05B 12/18*** | (2018.01) |
| ***B05B 14/30*** | (2018.01) |
| ***B05B 1/30*** | (2006.01) |
| *B05B 12/00* | (2018.01) |
| *B05B 13/00* | (2006.01) |

(52) U.S. Cl.
CPC ..... *B05B 13/0405* (2013.01); *B05B 14/30* (2018.02); *B05B 14/49* (2018.02); *B41J 2/01* (2013.01); *B41J 29/377* (2013.01); *B05B 12/00* (2013.01); *B05B 13/005* (2013.01)

(58) Field of Classification Search
CPC ... B05B 13/005; B05B 13/0405; B05B 14/30; B05B 14/49
See application file for complete search history.

(56) References Cited

U.S. PATENT DOCUMENTS

| | | | | |
|---|---|---|---|---|
| 6,203,152 | B1 * | 3/2001 | Boleda | B41J 29/377 347/102 |
| 9,452,616 | B1 | 9/2016 | Mathis et al. | |
| 2006/0023021 | A1 | 2/2006 | Shimizu | |
| 2008/0079795 | A1 * | 4/2008 | Nakazawa | B41J 11/002 347/102 |
| 2016/0355026 | A1 | 12/2016 | Mathis et al. | |
| 2018/0201029 | A1 | 7/2018 | Mathis | |
| 2019/0232648 | A1 * | 8/2019 | Hiramatsu | B41J 29/38 |

FOREIGN PATENT DOCUMENTS

| | | | |
|---|---|---|---|
| JP | H01-136900 | A | 5/1989 |
| JP | 2016-221958 | A | 12/2016 |

* cited by examiner

FIG. 10A
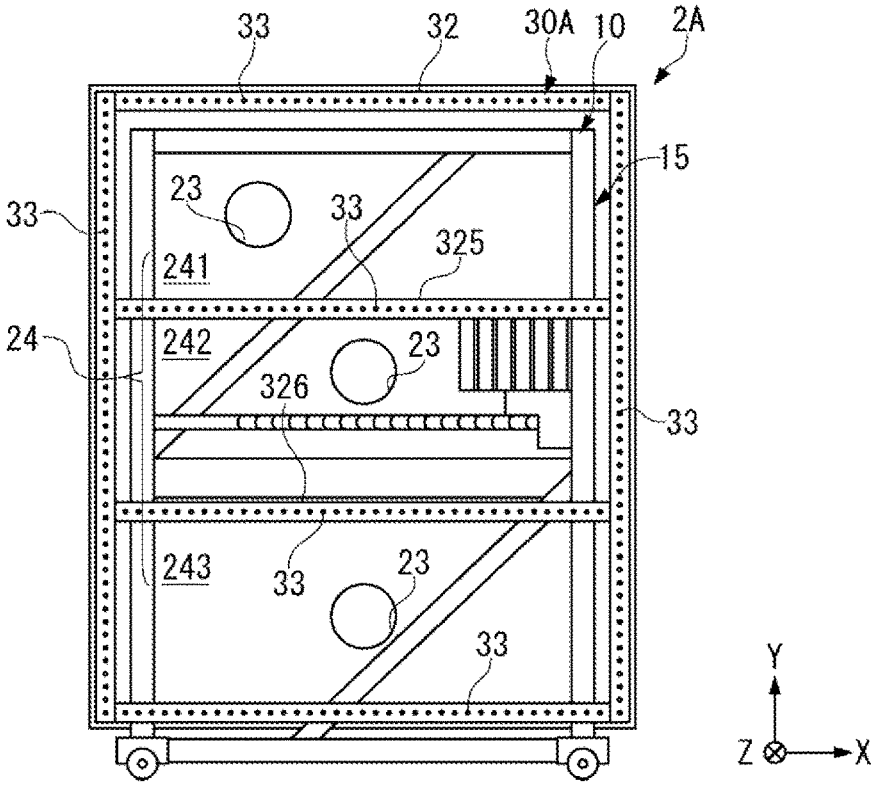
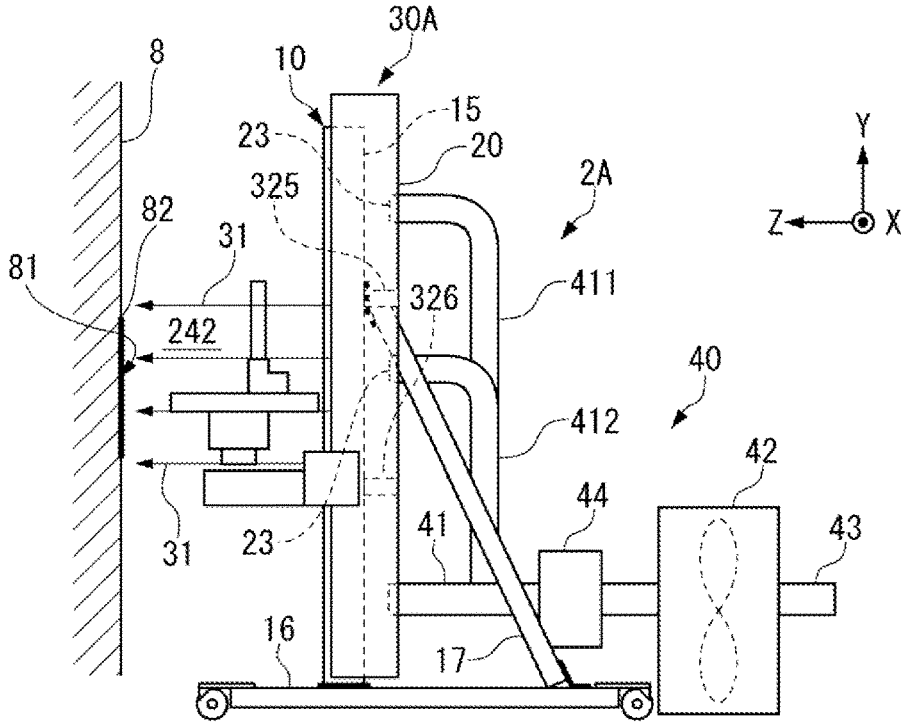
FIG. 10B

EXHAUST DEVICE FOR INKJET COATING, INKJET EJECTION DEVICE, INKJET COATING METHOD, AND METHOD FOR MANUFACTURING MEMBER

BACKGROUND OF THE INVENTION

Field of the Invention

The present invention relates to an exhaust device configured to exhaust air when coating and printing a member using an inkjet liquid ejection device, an inkjet ejection device configured to eject a liquid such as paint or ink, an inkjet coating method, and a method for manufacturing a member.

Description of the Related Art

Conventionally, air spray coating with compressed air to atomize paint has been used to coat an outer surface of an airframe of an aircraft. For example, as disclosed in JP 1-136900A, during air spray coating, the airframe is entirely covered with a cover frame to prevent scattering of paint mist, and air inside the cover frame is sucked by a suction device.

Different airframes of aircrafts are differently decoratively coated. In a process of air spray decorative coating, marking of a reference position or the like, masking, and the like need to be repeated for each color used.

From recent widespread use of inkjet technologies, for example, as disclosed in JP 2016-221958A, it is considered to coat an airframe of an aircraft by inkjet coating. In the inkjet coating, since an ejection head can be moved while ejecting inks of a plurality of colors in a timely manner based on image data, a workload for decorative coating can be reduced as compared to the air spray coating.

Also, unlike the air spray coating, scatter of atomized paint can be prevented in the inkjet coating.

To achieve inkjet coating of a large member such as an aircraft member, solvent vapor generated from a coated film of a large area needs to be discharged.

Introducing and maintaining large exhaust equipment entirely covering an airframe as disclosed in JP 1-136900A requires enormous cost. Thus, it is considered to use an exhauster, which is used for collecting and discharging dust, solvent vapor, or the like, to suck ambient atmosphere around an object to be coated during inkjet coating. However, air sucked by the exhauster has an influence on flying of a droplet ejected from a nozzle of an inkjet head, which displaces a landing position of the droplet relative to a defined position on a surface of the object to be coated, leading to a reduction in drawing quality.

From the above, an object of the present invention is to provide an exhaust device capable of reducing an influence on flying of a droplet ejected from a nozzle of an inkjet head, and exhausting vapor of a solvent contained in a coated film.

Another object of the present invention is to provide an inkjet ejection device capable of reducing an influence of a flow of ambient atmosphere on flying of a droplet.

A further object of the present invention is to provide an inkjet coating method and a method for manufacturing a member that allow the above.

SUMMARY OF THE INVENTION

An exhaust device for inkjet coating of the present invention includes: a cover that covers at least a target range on an object to be coated, the target range being a range in which a droplet lands that is ejected from an ejection nozzle of an inkjet head to a surface of the object to be coated; an air blow mechanism configured to supply an air jet around the target range and within a region of the cover projected onto the object to be coated; and an external communication portion through which a compartment surrounded by the cover, the object to be coated, and the jet communicates with an outside.

The exhaust device for inkjet coating of the present invention preferably includes an exhaust mechanism configured to exhaust air from the compartment.

In the exhaust device for inkjet coating of the present invention, the air blow mechanism preferably supplies the jet from outside to inside the target range.

In the exhaust device for inkjet coating of the present invention, it is preferable that the air blow mechanism supplies the jet around and also into the target range to form a plurality of compartments surrounded by the cover, the object to be coated, and the jet, and that the plurality of compartments each communicate with the outside of the compartments through external communication portions.

In the exhaust device for inkjet coating of the present invention, it is preferable that the air blow mechanism includes a supply duct into which air pressurized with respect to atmospheric pressure is introduced, and a plurality of jet nozzles configured to discharge air in the supply duct to form the jet.

In the exhaust device for inkjet coating of the present invention, the cover and the supply duct arranged at a peripheral edge on one surface of the cover constitute a box-like enclosure.

An exhaust device for inkjet coating of the present invention includes: a cover that covers at least a target range on an object to be coated, the target range being a range in which a droplet lands that is ejected from an ejection nozzle of an inkjet head to a surface of the object to be coated; a closing member that closes a gap between the cover and the object to be coated around the target range; an external communication portion through which a compartment surrounded by the cover, the object to be coated, and the closing member communicates with an outside; and an exhaust mechanism configured to exhaust air from the compartment.

In the exhaust device for inkjet coating of the present invention, the external communication portion is preferably an opening extending through the cover.

It is preferable that the exhaust device for inkjet coating of the present invention includes an exhaust mechanism configured to exhaust air from the compartment, and that the exhaust mechanism includes an exhaust duct connected to the external communication portion, and an exhauster configured to exhaust air from the compartment through the exhaust duct.

An inkjet ejection device of the present invention preferably includes an inkjet head including an ejection nozzle configured to eject a droplet to an object to be coated, and an airflow supply mechanism configured to supply an airflow along a traveling direction of the droplet from near the ejection nozzle toward the object to be coated.

In the inkjet ejection device of the present invention, the airflow supply mechanism preferably supplies a pair of airflows with a path of the droplet therebetween.

In the inkjet ejection device of the present invention, a supply nozzle included in the airflow supply mechanism is preferably integrally formed with the inkjet head to follow movement of the inkjet head.

In the inkjet ejection device of the present invention, it is preferable that the following equation is satisfied:

$$\theta = \tan^{-1}\left(\frac{u_x}{u_z}\right) \quad \text{[Formula 1]}$$

where $u_z$ is an initial speed of the droplet immediately after being ejected from the ejection nozzle in a first direction, $u_x$ is a speed of movement of the inkjet head in a second direction relative to the object to be coated, and θ is an angle formed between a vector of a speed of movement of the droplet ejected from the ejection nozzle of the inkjet head moving in the second direction and a vector of the initial speed in the first direction, and that the airflow supply mechanism is configured to be able to change the direction of the airflow based on $u_x$ and $u_z$.

An inkjet coating method of the present invention includes the steps of: covering at least a target range on an object to be coated with a cover, the target range being a range in which a droplet lands that is ejected from an ejection nozzle of an inkjet head to a surface of the object to be coated; and ejecting the droplet from the ejection nozzle to coat the object to be coated while supplying an air jet around the target range and within a region of the cover projected onto the object to be coated, and causing a compartment surrounded by the cover, the object to be coated, and the jet to communicate with an outside of the cover.

An inkjet coating method of the present invention includes the step of coating an object to be coated using an exhaust device for inkjet coating as described above.

An inkjet coating method of the present invention includes the steps of: covering at least a target range on an object to be coated with a cover, the target range being a range in which a droplet lands that is ejected from an ejection nozzle of an inkjet head to a surface of the object to be coated; and ejecting the droplet from the ejection nozzle to coat the object to be coated while supplying an air jet around the target range and within a region of the cover projected onto the object to be coated, and supplying, toward the object to be coated, an airflow along a traveling direction of the droplet from near the ejection nozzle configured to eject the droplet to the object to be coated.

The inkjet coating method of the present invention preferably further includes the step of arranging a receiving member as a separate member adjacent to the object to be coated; and coating the object to be coated while receiving an air jet with the receiving member instead of the object to be coated.

An inkjet coating method of the present invention includes the step of ejecting a droplet from an ejection nozzle to coat an object to be coated while supplying, toward the object to be coated, an airflow along a traveling direction of the droplet from near the ejection nozzle configured to eject the droplet to the object to be coated.

An inkjet coating method of the present invention includes the step of coating an object to be coated using an inkjet ejection device as described above.

An inkjet coating method of the present invention includes the steps of: covering at least a target range on an object to be coated with a cover, the target range being a range in which a droplet lands that is ejected from an ejection nozzle of an inkjet head to a surface of the object to be coated; closing a gap between the cover and the object to be coated around the target range with a closing member; exhausting air from a compartment surrounded by the cover, the object to be coated, and the closing member while causing the compartment to communicate with an outside of the cover; and ejecting the droplet from the ejection nozzle to coat the object to be coated.

The present invention also provides a method for manufacturing a member including the step of coating a member using an inkjet coating method as described above.

In the method for manufacturing a member of the present invention, the member preferably constitutes an airframe of an aircraft.

According to the exhaust device for inkjet coating and the coating method involving exhausting air of the present invention, solvent vapor can be trapped in the compartment surrounded by the jet from the air blow mechanism, the cover, and the object to be coated, and the jet can facilitate exhausting air from the compartment, thereby allowing the solvent vapor to be efficiently collected and discharged. The present invention can sufficiently exhaust the vapor of the solvent contained in a coated film while reducing an influence of the droplet ejected from the nozzle of the inkjet head on flying of the droplet, as compared to a case where an exhauster is used to discharge dust or solvent vapor in a general method as described later.

According to the inkjet ejection device and the coating method involving supplying an airflow from near the ejection nozzle of the present invention, the airflow is supplied along the traveling direction of the droplet from near the ejection nozzle configured to eject the droplet to the object to be coated, thereby keeping constant states of pressure, flow speed, flow rate, or the like of atmosphere in which the droplet flies. This can reduce an influence of a flow of ambient atmosphere such as air from the exhauster for discharging the solvent vapor on flying of the droplet to ensure drawing quality.

BRIEF DESCRIPTION OF THE DRAWINGS

FIG. 3A is a cutaway view of the ejection head taken along the line IIIa-IIIa of FIG. 3B and schematically shows the ejection nozzle in the direction of arrow IIIb in FIG. 3A;

FIG. 10A is a front view of an exhaust device and an inkjet ejection device according to a second embodiment, and FIG. 10B is a side view of the exhaust device and the inkjet ejection device according to the second embodiment;

DETAILED DESCRIPTION OF THE PREFERRED EMBODIMENTS

Now, an exhaust device for inkjet coating according to first and second embodiments will be described, and then an inkjet ejection device according to a third embodiment will be described.

The first to third embodiments all relate to a method for coting a member using an inkjet technology for ejecting a droplet to be deposited on an object.

First Embodiment

First, with reference to FIGS. 1 to 3, an object to be coated 8 and an inkjet ejection device 10 will be described, and then with reference to FIGS. 4 to 7, an exhaust device 2 used with the inkjet ejection device 10 for inkjet coating will be described.

(Object to be Coated)

Figure 1:
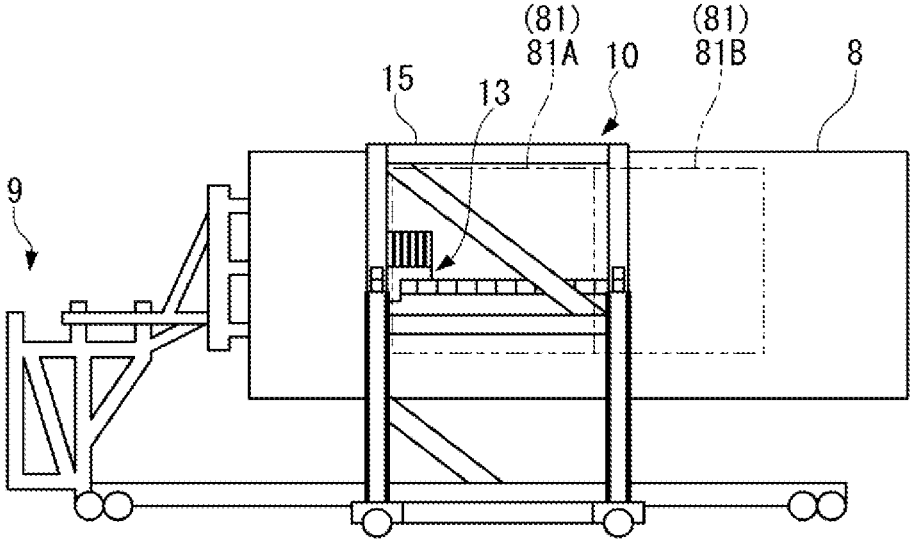
FIG. 1 shows an object to be coated and an inkjet ejection device.

FIG. 1 shows the inkjet ejection device 10, and the object to be coated 8 that is a member whose outer surface is coated by the inkjet ejection device 10. The object to be coated 8 supported by a support device 9 in this embodiment is longer than the inkjet ejection device 10 in a horizontal direction.

The object to be coated 8 is a skin of a member such as a main wing or a tail that constitutes an airframe of an aircraft. This is an example, and the object to be coated 8 may be a member that constitutes a mobile body such as a body structure of a railroad vehicle or an automobile body, or, not limited to the mobile body, may be any appropriate member.

As shown in FIG. 1, the object to be coated 8 is supported by the support device 9 with a surface to be coated being directed laterally. The object to be coated 8 is supported by the support device 9, and carried to a place for coating operation and installed.

For coating the object to be coated 8 in this embodiment, a liquid (paint, ink) is used that can form a coated film with a physical property that satisfies weatherability required for aircraft operation. Now, the liquid used for coating in this embodiment is referred to as "ink".

In this embodiment, a plurality of inks of different colors are used for color coating. For example, inks of cyan, magenta, yellow, and black can be used to achieve any patterns by a halftone printing method.

(Inkjet Ejection Device)

Figure 2A:
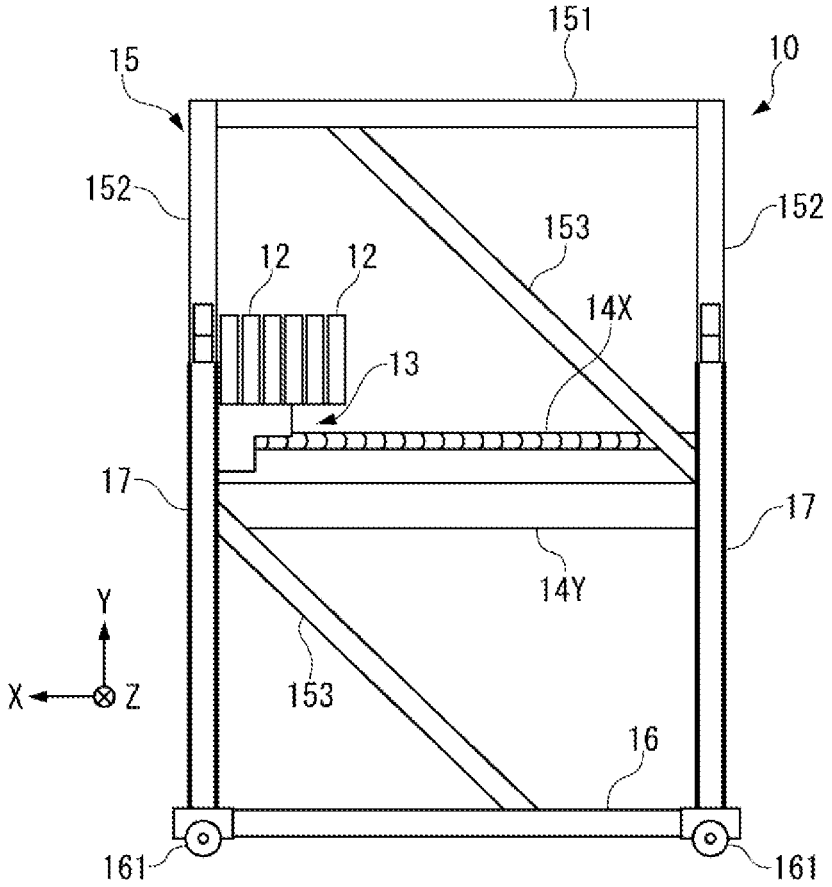
FIG. 2A is a rear view of the inkjet ejection device.
Figure 2B:
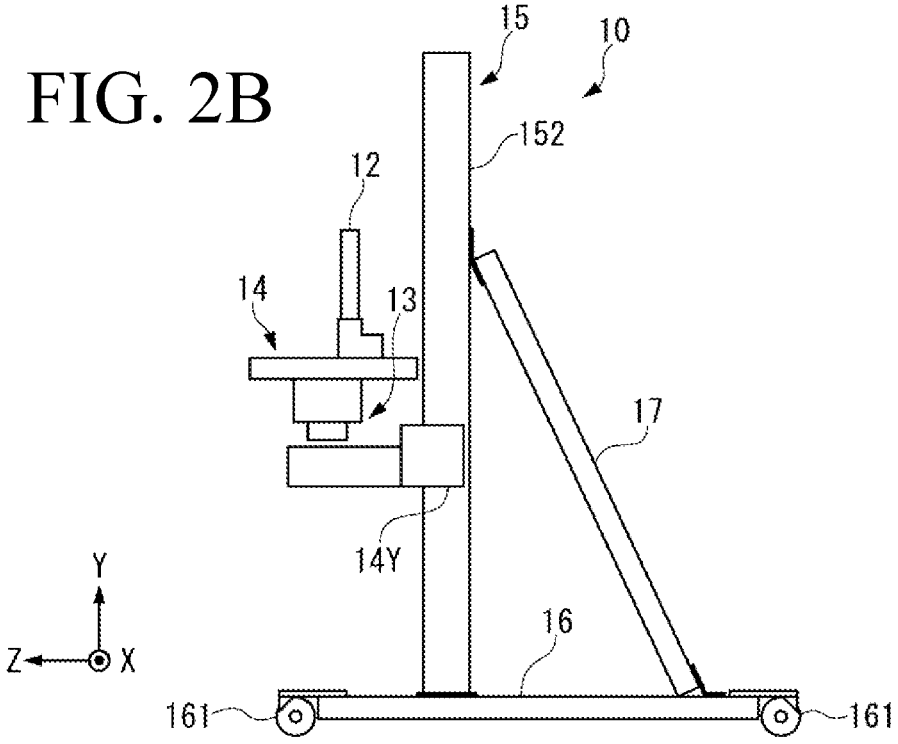
FIG. 2B is a side view of the inkjet ejection device.

With reference to FIGS. 1, 2A, and 2B, an example of a configuration of the inkjet ejection device 10 will be described.

As shown in FIGS. 1 and 2, the inkjet ejection device 10 includes a head device 13 including ejection heads 11 (FIG. 3A) as a plurality of inkjet heads configured for respective colors and a plurality of ink tanks 12 storing inks of the respective colors, a drive mechanism 14 configured to drive the head device 13, a control unit (not shown) configured to provide control instructions to the head device 13 and the drive mechanism 14 based on image data, a frame 15 supporting the head device 13 and the drive mechanism 14, a base 16, and columns 17.

The head device 13 is driven relative to the object to be coated 8 to a predetermined position in an X direction and a Y direction by drive portions 14X, 14Y, and ejects the inks from nozzles (not shown) of the ejection heads 11 of the respective colors.

The drive mechanism 14 includes the X direction drive portion 14X configured to drive the head device 13 in the X direction, and the Y direction drive portion 14Y configured to drive the head device 13 in the Y direction. The drive mechanism 14 can include a Z direction drive portion configured to drive the head device 13 in a Z direction.

The X direction drive portion 14X is assembled to the Y direction drive portion 14Y. The Y direction drive portion 14Y is moved parallel to a vertical member 152 of the frame 15.

Figure 6:
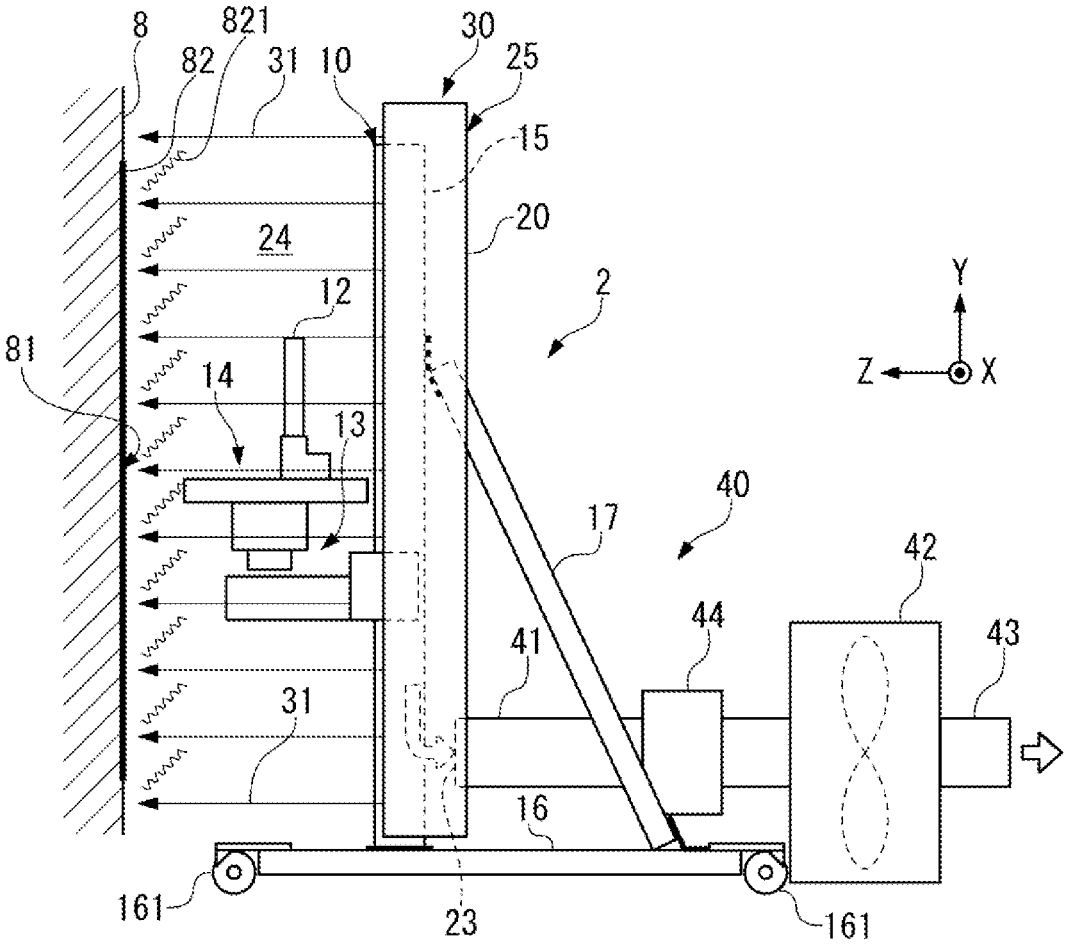
FIG. 6 is a side view of a usage state of the exhaust device during inkjet coating.

As shown in FIGS. 2B and 6, the drive mechanism 14 and the head device 13 are arranged between the frame 15 and the object to be coated 8.

The frame 15 includes two vertical members 152 along the Y direction, and a horizontal member 151 along the X direction connecting the vertical members 152 at an upper end, and a reinforcement 153. The reinforcement 153 is inclined to the X direction and the Y direction relative to a rectangular frame body constituted by the two vertical members 152, the horizontal member 151, and the base 16.

The vertical member 152 is vertically installed on the base 16 while being supported by the column 17 inclined to a vertical direction (Y direction).

The base 16 includes wheels 161 to allow the entire inkjet ejection device 10 to be moved in the horizontal direction.

In order to relatively move the inkjet ejection device 10 and the object to be coated 8 with a defined relative position, a rail (not shown) may be used that is configured to guide one or both of the inkjet ejection device 10 and the object to be coated 8 in a movement direction.

A target range 81 for coating on the object to be coated 8 is appropriately set depending on a drawing region by the inkjet ejection device 10.

The target range 81 in this embodiment corresponds to a maximum droplet ejectable range in which the drive portions 14X, 14Y can move the head device 13 to the maximum in the X direction and the Y direction to eject ink droplets to land on a surface of the object to be coated 8. Typically, the object to be coated 8 may have a rectangular target range 81.

When the inkjet ejection device 10 is moved relative to the object to be coated 8, as shown in FIG. 1, a target range 81B adjacent to a target range 81A can be coated.

(Discharge Head)

Figure 3A:
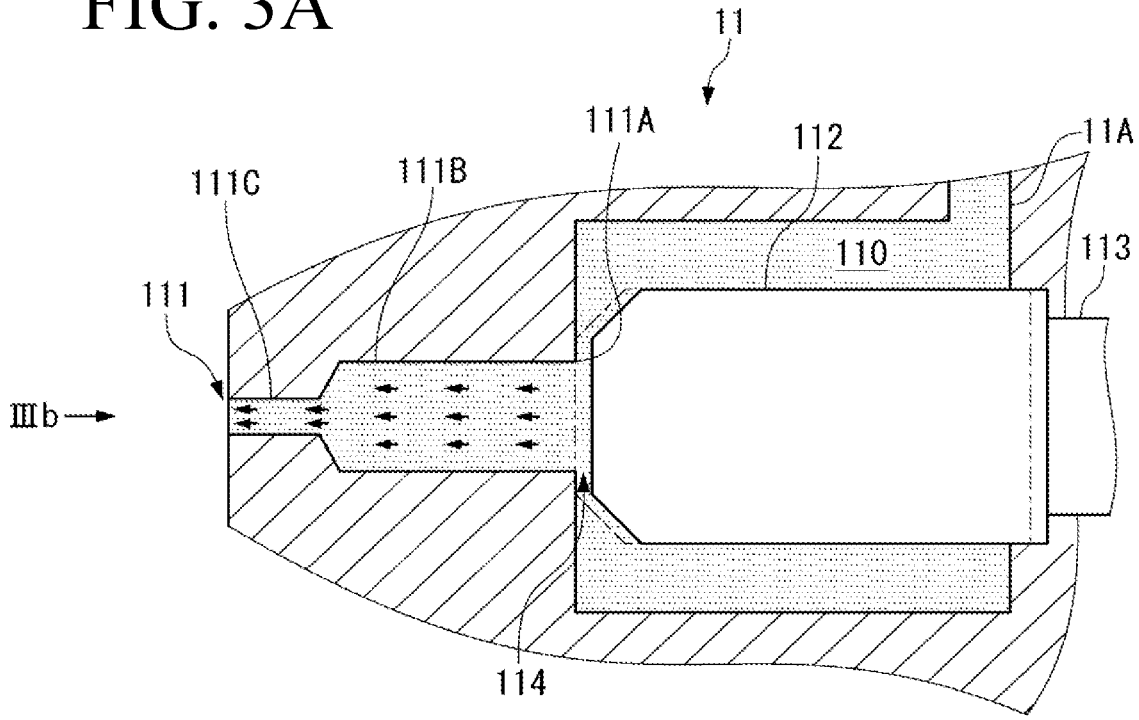
FIG. 3A schematically shows an ejection nozzle included in an ejection head of the inkjet ejection device in FIGS. 1 and 2.
Figure 3B:
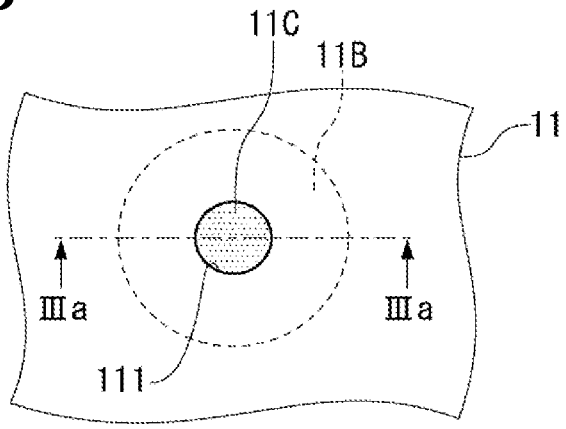

With reference to FIGS. 3A and 3B showing only part of the ejection head 11, an exemplary configuration of the ejection head 11 will be described.

The ejection head 11 includes an ink chamber 110 into which the ink is supplied from the ink tank 12 (FIG. 1) through a supply channel 11A, an ejection nozzle 111 communicating with the ink chamber 110, a pin 112 as a valve body that closes an inlet 111A of the ejection nozzle 111, and an actuator 113 configured to move the pin 112 toward and away from the inlet 111A. An ink supply mechanism (not shown) pressurizes the ink in the ink chamber 110 at constant pressure.

In this embodiment, the ink chamber 110 is pressurized and a valve 114 is opened and closed, thereby obtaining energy required for ejecting the ink from the ejection nozzle 111. As a method for obtaining energy required for ejecting the ink, a so-called thermal method of heating the ink to generate air bubbles may be adopted.

The ejection nozzle 111 corresponds to a channel extending through a wall of the ejection head 11 or a plate (not shown) provided on the wall. The ejection nozzle 111 does not always need to have a circular section, but may have any sectional shape such as a rectangular section.

In order to reduce pressure loss of the ink, the ejection nozzle 111 has an introduction channel 111B with a larger sectional area than an ejection channel 111C through which the ink is ejected.

When the actuator 113 including a piezoelectric element moves the pin 112 away from the inlet 111A, the valve 114 is opened for a predetermined open time. While the valve 114 is opened, the ink is ejected from an outlet of the ejection nozzle 111. An ink droplet is ejected once from the ejection nozzle 111 every time the valve 114 is opened.

The droplet ejected from the ejection nozzle 111 lands on the surface of the object to be coated 8 to form a dot (granular pixel). A group of dots constitute a coated film.

(Exhaust Device)

Next, with reference to FIGS. 4 to 7, an exhaust device 2 for inkjet coating will be described.

The exhaust device 2 discharges vapor of a solvent contained in paint during inkjet coating. Unlike air spray coating in which a spray gun is used to atomize paint, ink droplets do not fly during the inkjet coating, but the vapor of the solvent contained in the ink is generated from the coated film deposited on the object to be coated 8.

Then, the exhaust device 2 traps the solvent vapor in a compartment 24 (FIG. 6) surrounding the coated film from which the solvent vapor is generated to prevent diffusion of the solvent vapor to the environment, and discharges the solvent vapor in the compartment 24 out of the compartment 24. As described later, the compartment 24 is a space surrounded by a cover 20 facing the target range 81 of the object to be coated 8, jet 31 from an air blow mechanism 30, and the object to be coated 8.

As shown in FIGS. 4 to 7, the exhaust device 2 includes at least the cover 20, the air blow mechanism 30, and an external communication portion (external communication opening 23). The exhaust device 2 may include an exhaust mechanism 40 (FIG. 6) as required to sufficiently exhaust the solvent vapor.

As shown in FIG. 6, the cover 20 covers at least the target range 81 (FIG. 5(*a*)) of the object to be coated 8 from a rear side of the head device 13. The cover 20 is formed in a rectangular plate shape with a larger dimension in the X direction and the Y direction than the frame 15 correspondingly to shapes of the target range 81 and the frame 15. The cover 20 in this embodiment covers the target range 81 from a rear side of the frame 15.

The cover 20 has one or more external communication openings 23 (FIG. 4) as an external communication portion for exhausting air. The external communication opening 23 extends through the cover 20 in a thickness direction.

Figure 7:
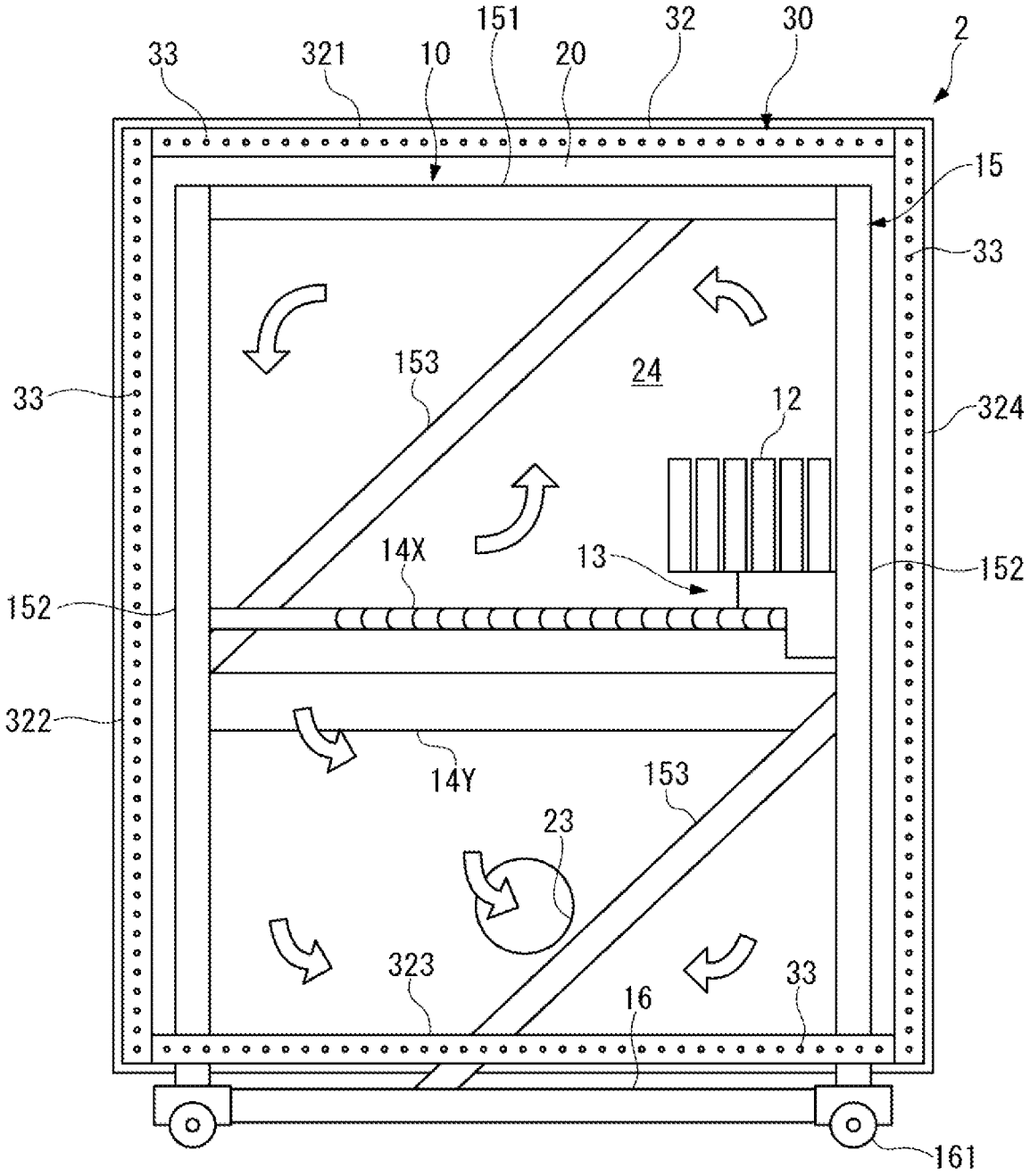
FIG. 7 is a front view of the inkjet ejection device and the exhaust device, and schematically shows an image of a flow of gas in a compartment surrounded by the cover, the object to be coated, and the jet.

The cover 20 may have notches or be constituted by a plurality of divided members so as to be arranged around the frame 15 as shown in FIG. 7 while avoiding interference with the frame 15 and the columns 17. A supply duct 32 of the air blow mechanism 30 described below may be constituted by a plurality of ducts for the same reason.

Figure 5A:
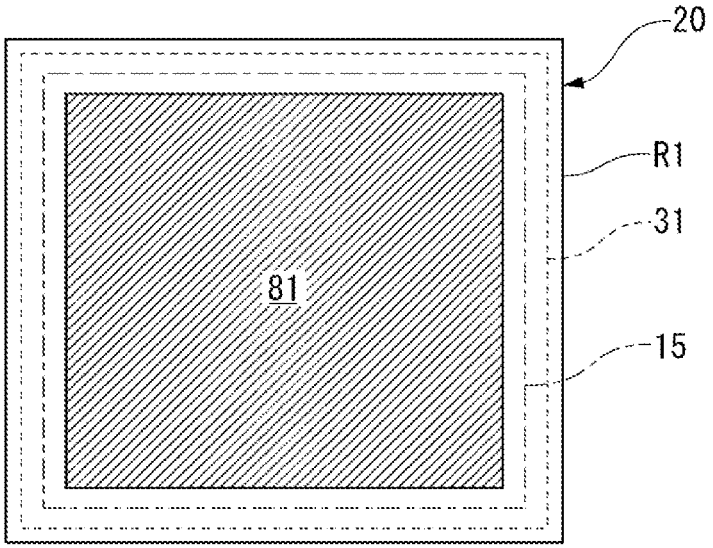
FIGS. 5A and 5B schematically show relationships between a region of a cover of the exhaust device projected onto an object to be coated in FIG. 4, a target range, and a position of a jet.

With the cover 20 being arranged around (outside) the frame 15, as shown in FIGS. 5A and 6, when the target range 81 is the maximum droplet ejectable range, the solvent vapor can be exhausted from the entire coated film 82 applied on the target range 81. The target range 81 in FIG. 5A extends over substantially the entire region inside the frame 15 shown by a dash dot line.

Figure 5B:
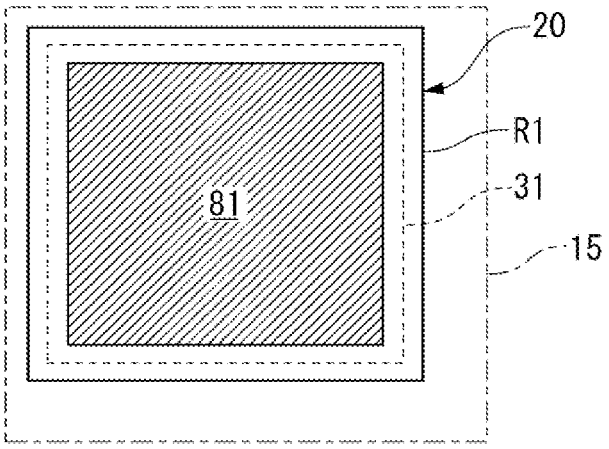

The target range 81 does not always need to be the maximum ejectable range, but may be appropriately set depending on an actual drawing range. Thus, as shown in FIG. 5B, the cover 20 may be arranged inside the frame 15.

The air blow mechanism 30 (FIGS. 4 and 6) supplies air jet 31 (FIG. 6) around the target range 81. As a position to which the jet 31 is supplied is shown by a dashed line in FIG. 5A, the air blow mechanism 30 supplies the air jet 31 around the hatched target range 81 and within a region R1 of the cover 20 projected onto the object to be coated 8 (inside a rectangle shown by a solid line). This also applies to FIG. 5B.

A direction of the jet 31 from a jet nozzle 33 is substantially the same as a traveling direction of the droplet ejected from the ejection nozzle 111. In the example in FIG. 6, the jet 31 is perpendicular to the surface of the object to be coated 8. The surface of the object to be coated 8 does not need to be always flat, but may be curved.

The air blow mechanism 30 in this embodiment includes a supply duct 32 into which air pressurized relative to atmospheric pressure is introduced, and a plurality of jet nozzles 33 configured to discharge air in the supply duct 32 to form the jet 31. The supply duct 32 can be connected to a pressurizing device (not shown) including a pump or a tank, or to a compressed air source provided in a work area.

The supply duct 32 is arranged at a peripheral edge of one surface of the cover 20 and integrally assembled with the cover 20. The cover 20 and the supply duct 32 arranged on one surface of the cover 20 constitute a box-like enclosure 25 (FIG. 6), and the cover 20 and the supply duct 32 cover the target range 81.

The supply duct 32 is constituted by a plurality of ducts 321 to 324. The ducts 321 to 324 are assembled into a rectangular shape.

As a variant (not shown) of the cover 20, the cover 20 may have a box shape including a plate-like cover body and a side wall rising from a peripheral edge of the cover body. In that case, the supply duct 32 may be mounted inside the cover 20.

In each of the ducts 321 to 324, many jet nozzles 33 are provided in line in an axial direction of the ducts. The jet nozzles 33 may be holes extending through a side wall of each of the ducts 321 to 324. Overall in the ducts 321 to 324, a group of jet nozzles 33 are arranged in a rectangular shape correspondingly to the shape of the target range 81.

The jet nozzle 33 may be formed into a slit shape along the axial direction of the duct.

The ducts 321 to 324 assembled into the rectangular shape may constitute a continuous channel including one inlet and one outlet, or may constitute two or more channels.

If a pressurizing device (not shown) supplies pressurized air into the ducts 321 to 324, each jet nozzle 33 discharges the pressurized air around the target range 81 to form the jet 31 (FIG. 6). The jet 31 blown around the entire target range 81 from each jet nozzle 33 traps the solvent vapor in the compartment 24 so as not to leak from between the cover 20 and the object to be coated 8.

Part of a periphery of the compartment 24 may have a section without the jet 31 (without the jet nozzle 33), and the section may be used as an external communication portion through which the compartment 24 communicates with an outside. A duct for exhausting air may be arranged in the section.

In this case, the cover 20 does not always need to have the external communication opening 23.

In this embodiment, the cover 20 and the supply duct 32 are assembled to the frame 15 of the inkjet ejection device 10 and supported. Thus, there is no need for a separate member for supporting the cover 20 and the supply duct 32. This does not apply to a case where the cover 20 and the supply duct 32 are self-supported or supported by a different support member.

As shown in FIG. 6, between the cover 20 facing the target range 81 of the object to be coated 8, the jet 31 from the air blow mechanism 30, and the object to be coated 8, the compartment 24 (space) is provided that is surrounded by the cover 20, the jet 31, and the object to be coated 8. The compartment 24 is separated from atmosphere outside the compartment 24 by the cover 20, the jet 31, and the object to be coated 8, and thus solvent vapor 821 (schematically shown by wavy lines) generated from the coated film 82 applied on the target range 81 remains in the compartment 24 adjacent to the coated film 82.

Specifically, the solvent vapor 821 only exists in the compartment 24, and thus may be exhausted through the external communication opening 23 through which the compartment 24 communicates with the outside.

The exhaust mechanism 40 (FIG. 6) includes an exhaust duct 41 connected to the external communication opening 23, and an exhauster 42 configured to exhaust air from the compartment 24 through the exhaust duct 41.

The exhauster 42 sucks air containing the solvent vapor 821 in the compartment 24 through the exhaust duct 41, and discharges the air through a discharge duct 43.

When the air sucked by the exhauster 42 is discharged into a room, the exhaust duct 41 may include a member or device 44 for cleaning air by removing the solvent vapor or reducing the content of the solvent vapor. The member or device 44 for cleaning air may be provided downstream of the exhauster 42. The air sucked by the exhauster 42 may be released into the room or outdoor atmosphere, or may be fed from the exhauster 42 through the duct to a different device or the like.

According to the exhaust device 2 of this embodiment as described above, the structure including the cover 20 and the supply duct 32 covers the target range 81, and the jet nozzle 33 discharges air toward the object to be coated 8, thereby allowing air containing the solvent vapor and flowing in the compartment 24 to be exhausted from the external communication opening 23 while preventing leakage of the solvent vapor from the compartment 24.

The air blow mechanism 30 discharges air to apply pressure into the compartment 24. Then, for example, as shown in FIG. 7, the pressurization facilitates a flow of the air in the compartment 24, and the air in the compartment 24 flows into the external communication opening 23 based on a difference between the pressure in the compartment 24 and pressure in the exhaust duct 41. The flow of the air in the compartment 24 changes depending on the shape of the object to be coated 8.

Thus, the exhaust device 2 can discharge the air in the compartment 24 to the outside even without actively exhausting the air using the exhaust mechanism 40. It is preferable that even if the exhaust device 2 includes no exhaust mechanism 40, an exhaust duct is connected to the external communication opening 23, and that the duct includes the member or device 44 for cleaning air as required.

The exhaust device 2 in this embodiment includes the exhaust mechanism 40 (FIG. 6) to suck the air in the compartment 24 to more reliably exhaust the solvent vapor in the compartment 24. Keeping a suction ability of the exhaust mechanism 40 and a flow speed and a flow rate of sucked air within limits necessary for reliably exhausting the solvent vapor is economical in terms of device cost, operation cost, or the like, and also preferable in terms of no influence on flying of a droplet ejected from the ejection nozzle 111 of the inkjet ejection device 10.

As compared to a flow speed and a flow rate required by an exhauster used in a general method of sucking air not only near the object to be coated 8 but also in positions away from the object to be coated 8 to collect and discharge solvent vapor, the flow speed and the flow rate of air required for the exhaust mechanism 40 used in the exhaust device 2 are significantly low and small.

With the exhauster used in the general method, an airflow sucked into the exhauster may cause a crosswind along a planar direction of the target range 81, thereby preventing proper traveling of the ink droplet ejected from the ejection nozzle 111. On the other hand, the direction of the jet 31 from the jet nozzle 33 is substantially the same as the traveling direction of the droplet, and the jet 31 is discharged toward the object to be coated 8 around the target range 81, that is, outside the target range 81 as described above.

From the above, an influence of the flow of the air in the compartment 24 sucked by the exhaust mechanism 40 and the jet 31 on flying of the droplet is smaller than the case where the exhauster is used in the general method.

As described above, in order to reduce an influence on flying of the droplet, prevent leakage of the solvent vapor from the compartment 24, and exhaust the solvent vapor from the compartment 24 through the external communication opening 23, a flow speed, a flow rate, and a direction of the jet 31 are preferably appropriately determined also in view of suction by the exhaust mechanism 40. The flow speed of the jet 31 on the surface of the target range 81 may be, for example, 0.5 m/s to 1.5 m/s.

(Inkjet Coating Method)

An inkjet coating method involving exhausting air will be described.

For coating the object to be coated 8, as shown in FIG. 6, the target range 81 is covered with the cover 20 and the supply duct 32.

In that state, the jet 31 is supplied around the target range 81 and within the region R1 of the cover 20 projected onto the object to be coated 8 (FIGS. 5A and 5B), and the droplet is ejected from the ejection nozzle 111 to coat the object to be coated 8 while causing the compartment 24 to communicate with the outside of the cover 20 through the external communication opening 23.

Through the above coating process, the object to be coated 8 is manufactured.

The exhaust device 2 is operated at least during the inkjet coating. The exhaust device 2 supplies the jet 31 around the target range 81 using the air blow mechanism 30, and operates the exhaust mechanism 40 as required. Thus, the solvent vapor 821 generated from the coated film 82 is discharged through the external communication opening 23 out of the compartment 24.

It is preferable that the exhaust device 2 is still operated for a while after the inkjet coating is finished to continue discharging the solvent vapor 821, thereby sufficiently removing the solvent vapor 821 from an operation environment.

According to the exhaust device 2 of this embodiment as described above, without entirely covering the object to be coated 8, the compartment 24 surrounding the coated film 82 that generates the solvent vapor 821 and is applied on the target range 81 being coated is formed to trap the solvent vapor 821. This can prevent diffusion of the solvent vapor to a surrounding environment, and sufficiently discharge the solvent vapor through the external communication opening 23 out of the compartment 24.

According to this embodiment, there is no need for large exhaust equipment entirely covering the object to be coated 8, thereby reducing cost for introduction or operation of the exhaust equipment.

According to this embodiment, the solvent vapor can be trapped in the compartment 24 surrounded by the jet 31 from the air blow mechanism 30, the cover 20, and the object to be coated 8, and the jet 31 can facilitate exhausting air from the compartment 24, thereby allowing the solvent vapor to be efficiently collected and discharged.

As described above, the flow speed and the flow rate of the air exhausted from the compartment 24 are lower and smaller than those when the exhauster is used in the general method, and the jet 31 is supplied around the target range 81 in substantially the same direction as the traveling direction of the droplet. Thus, as compared to the case where the exhauster is used in the general method, an influence of the jet 31 on flying of the droplet is negligibly small.

Thus, the droplet ejected from the ejection nozzle 111 lands on an appropriate position in the target range 81, thereby ensuring drawing quality.

From the above, according to the exhaust device 2 of this embodiment, the solvent vapor generated from the coated film 82 of a large area such as on a member of an airframe of an aircraft can be efficiently and sufficiently discharged with little influence on flying of the ink droplet from the ejection nozzle 111. Thus, inkjet coating of a large member can be achieved instead of conventional air spray coating.

[Variant of First Embodiment]

Figure 8A:
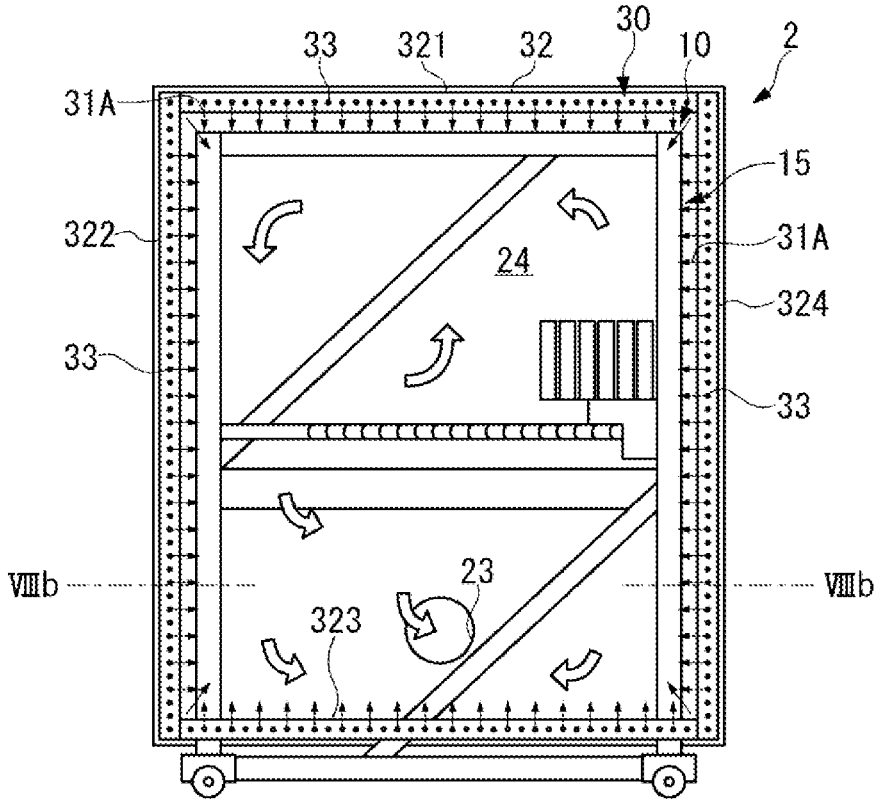
FIGS. 8A and 8B schematically show air blow from an exhaust device according to a variant of the first embodiment.
Figure 8B:
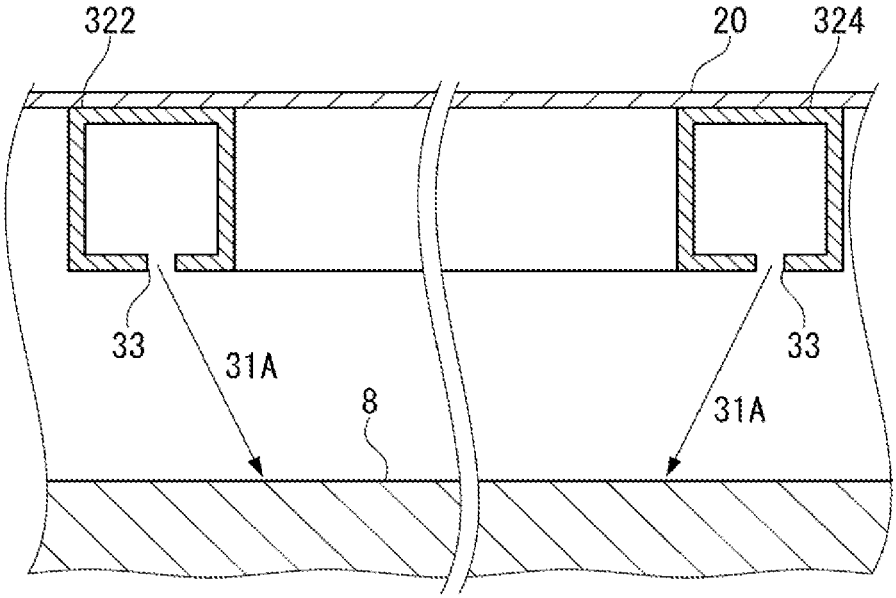

As shown in FIGS. 8A and 8B, the jet 31 from the air blow mechanism 30 may be discharged from the jet nozzle 33 from outside to inside in the planar direction of the target range 81. As shown in FIG. 8B, a jet 31A is inclined to the surface of the object to be coated 8. The jet 31A is directed inward to facilitate a flow of the air in the compartment 24. Thus, as compared to the above embodiment in which the jet 31 is perpendicular to the surface of the object to be coated 8, exhaust of the air can be facilitated.

Second Embodiment

Next, with reference to FIGS. 9, 10A, and 10B, an exhaust device 2A according to a second embodiment of the present invention will be described. Differences from the first embodiment will be mainly described below. The same components as in the first embodiment are denoted by the same reference numerals.

Figure 9:
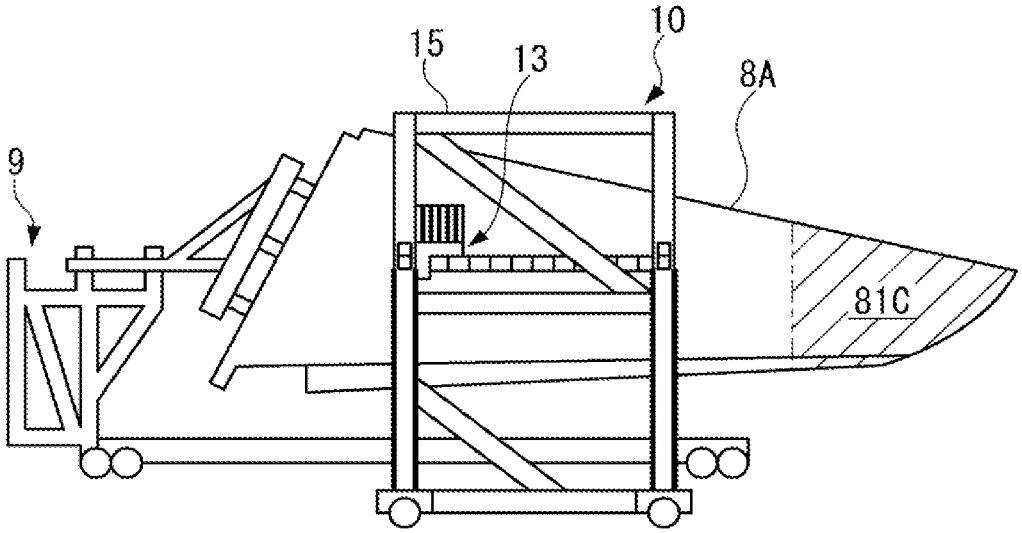
FIG. 9 shows a vertical tail of an aircraft as an object to be coated, and the inkjet ejection device.

FIG. 9 shows a vertical tail of an aircraft as an object to be coated 8A, and an inkjet ejection device 10. The object to be coated 8A has a decreasing width (vertical dimension in FIG. 9) toward an end (right in FIG. 9) of the vertical tail.

Thus, if the entire outer surface of the object to be coated 8A is coated, the dimension of the target range 81 sequentially changes while the inkjet ejection device 10 is moved relative to the object to be coated 8A in a horizontal direction.

Alternatively, even with the constant width of the object to be coated 8 as in FIG. 1, for example, the dimension of the target range 81 changes when the object to be coated 8 is coated with a small logo or pattern that fits in a small area and then coated with a large logo or pattern that extends over a large area.

In order to coat the object to be coated 8A while efficiently exhausting air in the above cases, the exhaust device 2A (FIGS. 10A and 10B) of the second embodiment uses a compartment 24 divided into two or more small compartments 241 to 243. Any one or two or all of the small compartments 241 to 243 matching the target range 81 to be coated may be selectively used.

If only a compartment with a coated film 82 that generates solvent vapor, for example, only the small compartment 242 in the middle in the vertical direction as shown in FIG. 10B is used in the entire compartment 24, the volume of the small compartment 242 is smaller than that of the compartment 24, thereby improving efficiency in collection and exhaust of the solvent vapor.

Thus, the exhaust device 2A includes an air blow mechanism 30A configured to supply the jet 31 around and also into the target range 81 to form the plurality of small compartments 241 to 243.

A supply duct 32 of the air blow mechanism 30A includes ducts 321 to 324 corresponding to four sides of the cover 20 and also dividing ducts 325,326 for dividing the compartment 24. Like the ducts 321 to 324, the dividing ducts 325, 326 include a plurality of jet nozzles 33.

Figure 11A:
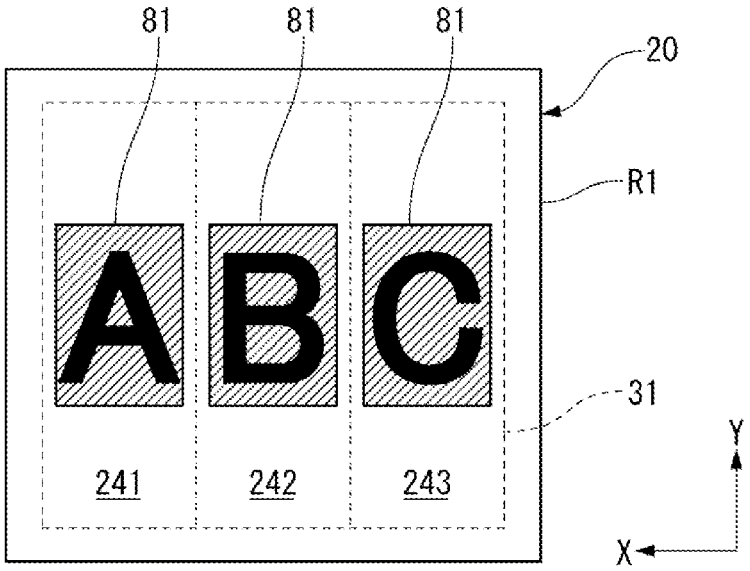
FIGS. 11A and 11B schematically show relationships between a target range for coating and a compartment for exhausting air.
Figure 11B:
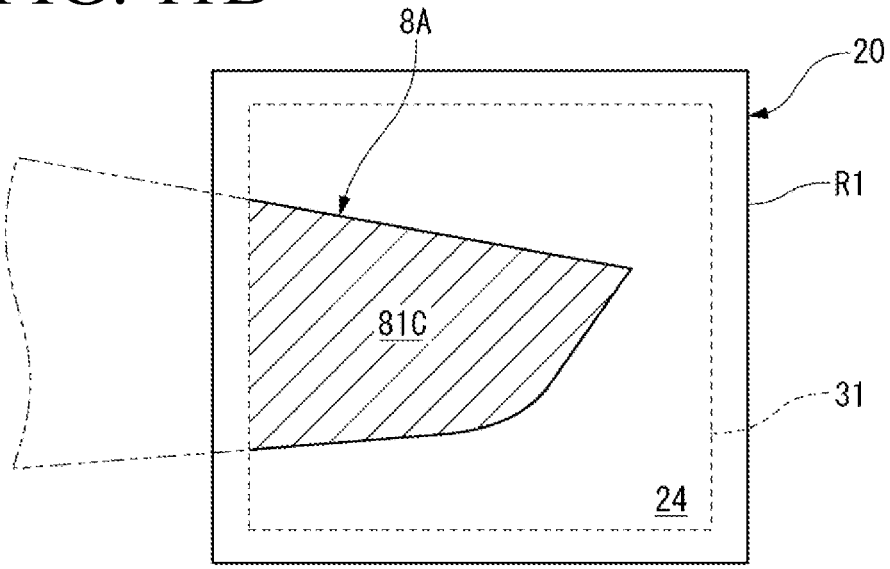

The small compartments 241 to 243 in this embodiment are arranged in the vertical direction (Y direction). However, as shown in FIG. 11A, the plurality of small compartments 241 to 243 may be arranged in the X direction.

As shown in FIG. 10A, the small compartments 241 to 243 formed by dividing the entire compartment 24 substantially equally among three each communicates with an outside through external communication openings 23 formed in a cover 20. The corresponding external communication openings 23 of the small compartments other than the small compartment corresponding to the target range 81 being coated are closed by lids, valves, or other suitable members included in the cover 20, an exhaust duct 411, or the like.

The exhaust duct 411 connected to the external communication opening 23 of the small compartment 241 and an exhaust duct 412 connected to the external communication opening 23 of the small compartment 242 are connected to an exhaust duct 41 corresponding to the small compartment 243, and thus connected via the exhaust duct 41 to a cleaning member or device 44 and an exhauster 42. The exhaust ducts 411, 412, 41 may be separately connected to the exhauster.

With the exhaust device 2A of the second embodiment, appropriate one of the small compartments 241 to 243 corresponding to the target range 81 can be used to efficiently discharge solvent vapor and perform coating operation while ensuring drawing quality.

Figure 12:
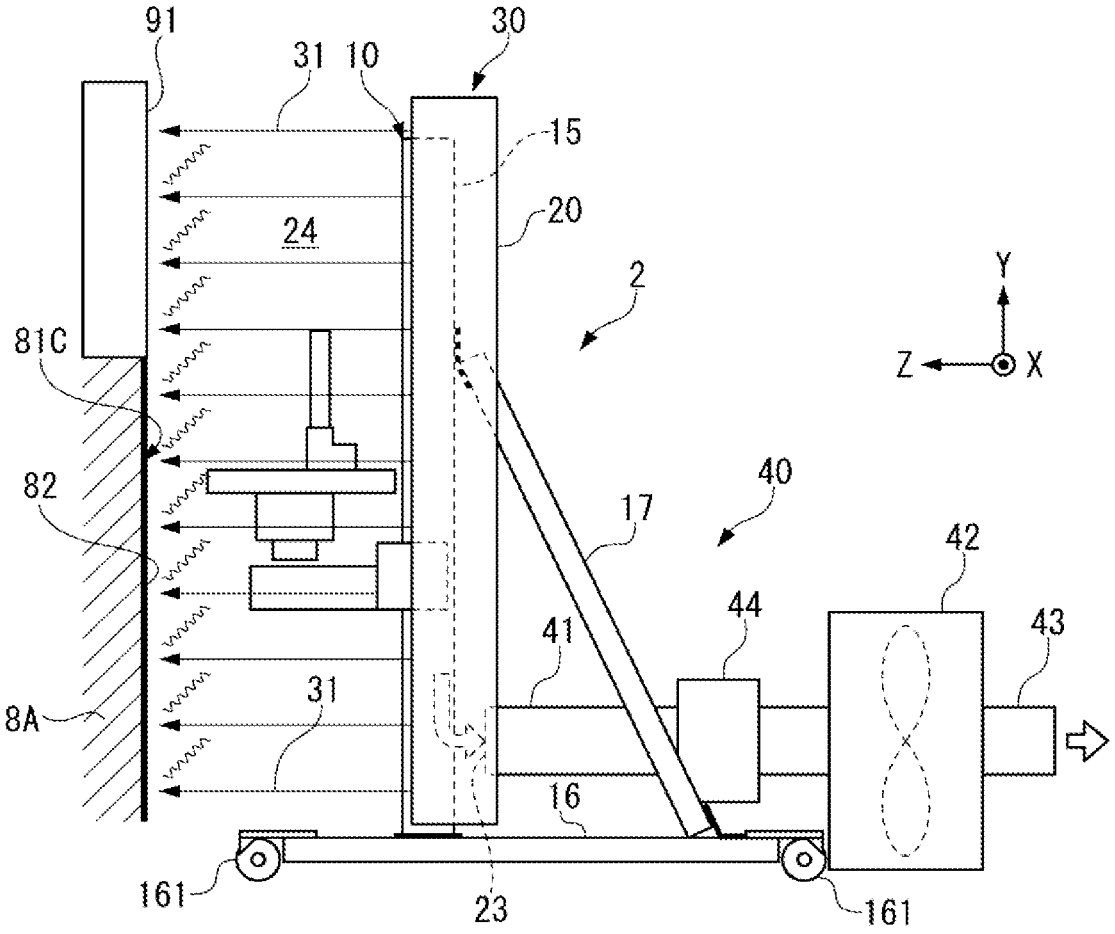
FIG. 12 shows a usage state of a member provided adjacent to an object to be coated to receive a jet.

In the above coating process, as shown in FIG. 12, a receiving member 91 configured to receive the jet 31 may be used as required to form the compartment 24 or the small compartments 241 to 243.

For example, in coating a target range 81C on an end side of the object to be coated 8A in FIG. 9, a coating area of the object to be coated 8A is smaller than an area of a region surrounded by the cover 20 and the jet 31 as shown in FIG.

11B. Specifically, no region of the object to be coated 8A faces the cover 20 and the jet 31.

In that case, as shown in FIG. 12, the receiving member 91 may be arranged adjacent to the object to be coated 8A to receive the jet 31 instead of the object to be coated 8A. Then, a compartment 24 surrounded by the cover 20, the jet 31, the object to be coated 8A, and the receiving member 91 is formed, and thus the object to be coated 8 may be coated while the solvent vapor is discharged from the compartment 24.

Through the above coating process, the object to be coated 8A is manufactured.

[Variant]

Figure 13:
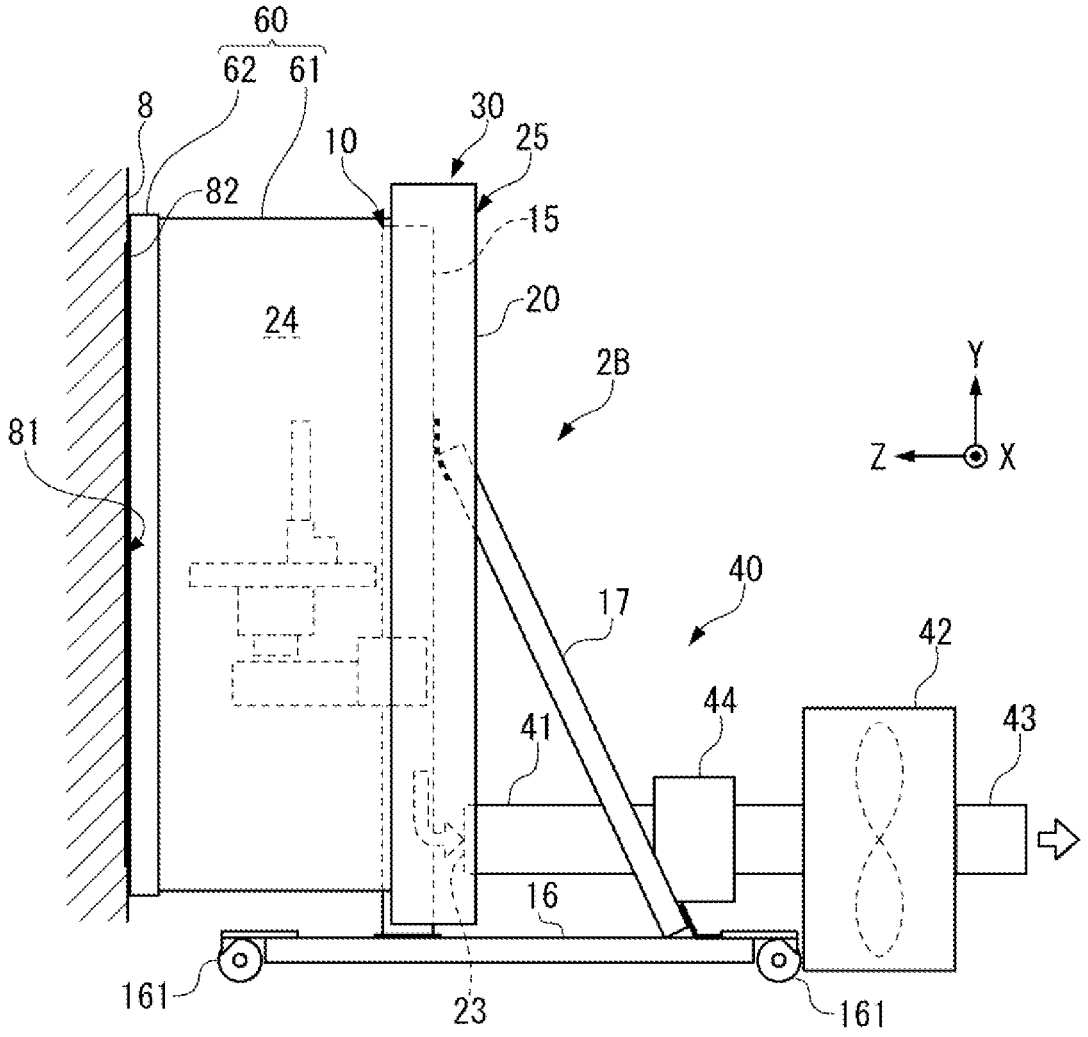
FIG. 13 is a side view of a usage state of an exhaust device according to a variant of the present invention.

FIG. 13 shows an exhaust device 2B according to a variant of the present invention, an inkjet ejection device 10, and an object to be coated 8.

The exhaust device 2B includes a cover 20 that covers a target range 81, a closing member 60 that closes a gap between the cover 20 and an object to be coated 8 around the target range 81, an external communication opening 23 through which a compartment 24 surrounded by the cover 20, the object to be coated 8, and the closing member 60 communicates with the outside, and an exhaust mechanism 40 configured to exhaust air from the compartment 24.

The exhaust device 2B includes the closing member 60 instead of the air blow mechanism 30 (FIGS. 4 and 6) described above. Other than those, the exhaust device 2B may be configured similarly to the exhaust device 2 in the first embodiment.

The closing member 60 includes a side wall 61 rising from four sides of the cover 20 toward the object to be coated 8, and a seal member 62 provided on the side wall 61 and in contact with the object to be coated 8.

The seal member 62 may be formed of a suitable rubber material such as fluororubber into an appropriate shape. The seal member 62 preferably has flexibility to fit the surface of the object to be coated 8 based on its material or shape, and comes into tight contact with the surface of the object to be coated 8.

The receiving member 91 in FIG. 12 may be used to bring the seal member 62 into contact with the object to be coated 8 and the receiving member 91 to form the compartment 24.

The seal member 62 is preferably resistant to chemicals contained in a coating liquid. The seal member 62 may be made of, for example, closed-cell fluororubber foam.

The side wall 61 and the seal member 62 seal between the cover 20 and the object to be coated 8 over the entire periphery of the target range 81 so as to prevent leakage of the solvent vapor from the compartment 24.

Thus, with the exhaust device 2B, like the exhaust device 2 in the first embodiment, without entirely covering the object to be coated 8, the solvent vapor 821 can be trapped in the compartment 24, and the exhaust mechanism 40 can sufficiently discharge the solvent vapor through the external communication opening 23 out of the compartment 24.

The closing member 60 may be configured to achieve the small compartments 241 to 243 as in the second embodiment (FIG. 10). In this case, the side wall 61 and the seal member 62 may be arranged on the positions of the dividing ducts 325, 326 in FIG. 10. Also, the small compartments 241 to 243 each have an external communication portion 23.

Third Embodiment

Next, with reference to FIGS. 14A and 14B, an inkjet ejection device according to a third embodiment of the present invention will be described.

The inkjet ejection device of the third embodiment includes an airflow supply mechanism 5 configured to supply, toward the object to be coated 8, an airflow along a traveling direction D1 of a droplet L from near an ejection nozzle 111 configured to eject the droplet to the object to be coated 8.

Providing the airflow supply mechanism 5 can reduce an influence of a flow of ambient atmosphere on flying of the ink droplet L and ensure drawing quality.

Figure 4:
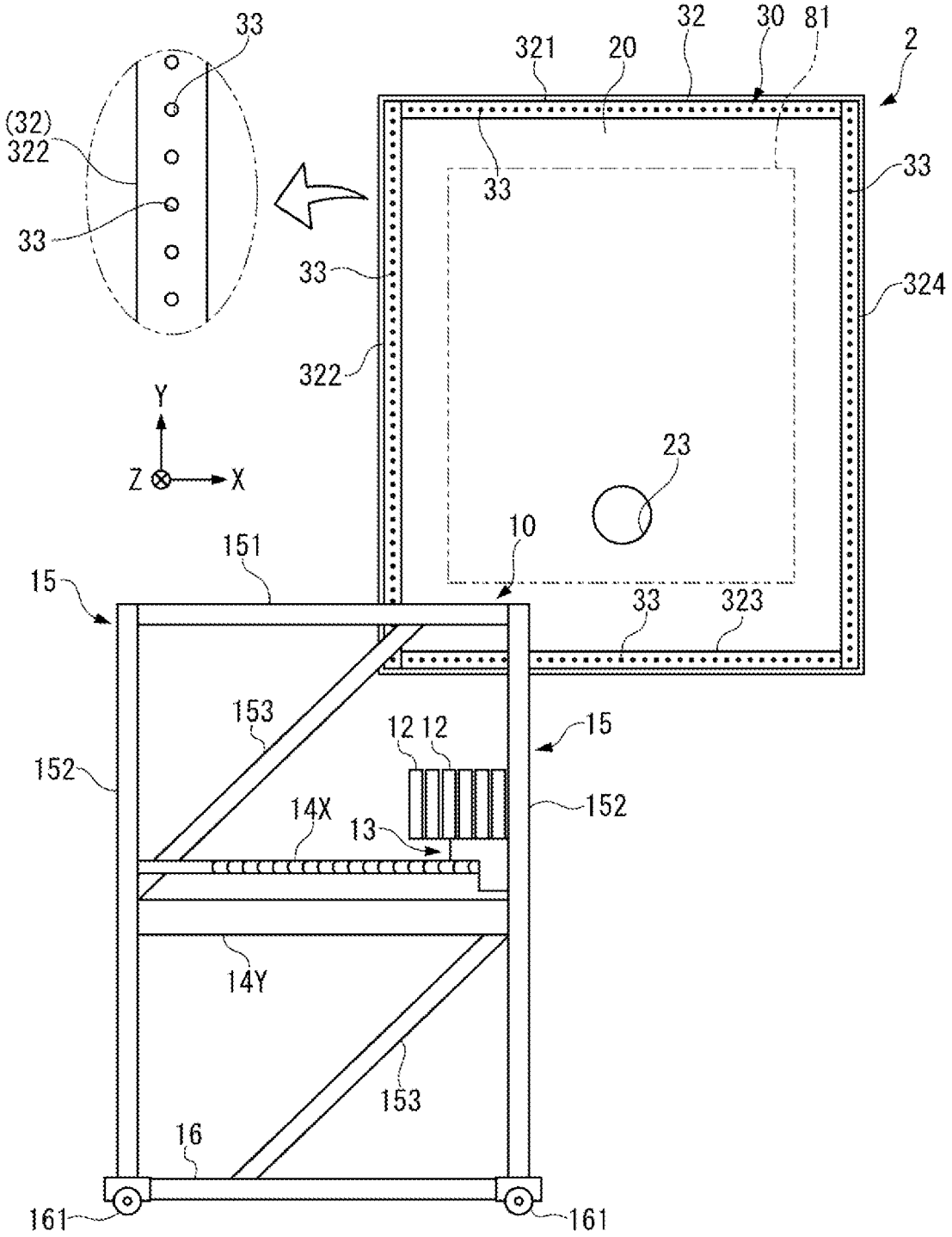
FIG. 4 is a front view of an exhaust device according to a first embodiment and the inkjet ejection device being separated from each other.

The inkjet ejection device of the third embodiment includes an ejection head 11 including the ejection nozzle 111 configured to eject the droplet L to the object to be coated 8, and the airflow supply mechanism 5. Other than including the airflow supply mechanism 5, the inkjet ejection device of the third embodiment may be configured similarly to the inkjet ejection device 10 in the first and second embodiments (FIGS. 2 and 4).

The airflow supply mechanism 5 may appropriately include, for example, a pressurizing device or a compressed air source including a pump or a tank, and a duct configured to guide air introduced therefrom near to the ejection nozzle 111.

It is preferable that the airflow supply mechanism 5 guides air near to each of the plurality of ejection nozzles 111 included in a head device 13 (FIG. 2), and supplies an airflow along the traveling direction D1 of the droplet L from near each ejection nozzle 111 toward the object to be coated 8.

Figure 14A:
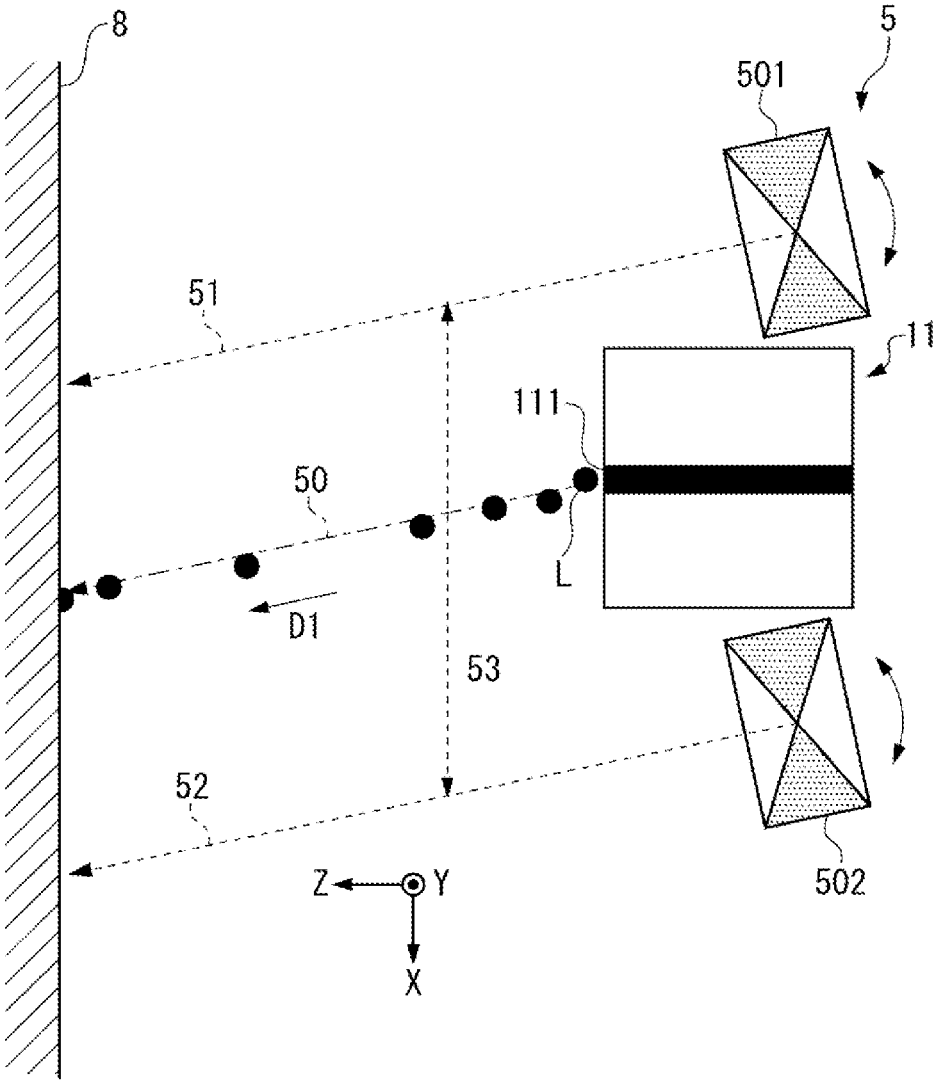
FIG. 14A schematically shows a head and an airflow supply mechanism of an inkjet ejection device according to a third embodiment, and FIG. 14B schematically shows a movement speed of an ejected droplet.

As shown in FIG. 14A, the airflow supply mechanism 5 preferably supplies a pair of airflows 51, 52 with a path 50 therebetween through which the droplet L flies along the traveling direction D1. The pair of airflows 51, 52 are formed by air flowing in the same direction as the traveling direction D1 of the droplet L from supply nozzles 501, 502 arranged near and symmetrically with respect to an outlet of the ejection nozzle 111. The airflows 51, 52 preferably have the same flow speed and flow rate so as to cause no difference in pressure between the sides of the airflow 51 and the airflow 52 of a gap 53 therebetween.

The droplet L flies through the gap 53 between the airflows 51, 52 parallel to each other. A width of the gap 53 may be appropriately determined in view of a size of the ink droplet L, a diameter of a dot formed on the object to be coated 8 by the landing droplet L, or the like. For example, the width of the gap 53 may be equal to the diameter of the dot.

The supply nozzles 501, 502 in this embodiment are arranged on opposite sides of the ejection nozzle 111 in a movement direction of the ejection head 11 (X direction in the example in FIG. 14A). In this embodiment, the droplet L is ejected from the ejection nozzle 111 when the ejection head 11 is continuously moved in the X direction, while no droplet L is ejected from the ejection nozzle 111 when the ejection head 11 is intermittently moved in the Y direction for drawing in the next step. Thus, to avoid an influence of a flow of atmosphere caused by the movement of the ejection head 11 on flying of the droplet L, the airflows 51, 52 are preferably formed by the supply nozzles 501, 502 arranged on the opposite sides of the ejection nozzle 111 in the movement direction of the ejection head 11 when the droplet L is ejected and in the X direction along which the ejection nozzle 111 is often moved.

However, not limited to this embodiment, the supply nozzles 501, 502 may be arranged on opposite sides of the ejection nozzle 111 in the Y direction, or arranged on the opposite sides in the X direction and the opposite sides in the Y direction.

Alternatively, a supply nozzle may be configured to form a cylindrical airflow from around an outlet of the ejection nozzle 111 toward the object to be coated 8. The cylindrical airflow can contribute to stable atmosphere in which the droplet L flies.

The airflows 51, 52 formed along the traveling direction D1 of the droplet L symmetrically with respect to the droplet L keep constant states of pressure, flow speed, and flow rate of atmosphere in which the droplet L flies. The airflows 51, 52 supplied from near the ejection nozzle 111 toward the object to be coated 8 can avoid an influence of a flow of ambient atmosphere caused by the air from the exhauster or the movement of the ejection head 11, and reliably provide a stable airflow state around the path 50 of the droplet L. This can keep the droplet L flying straight along the traveling direction D1, and allows the droplet L to land on a defined position on the object to be coated 8.

In order for the airflows 51, 52 from near the ejection nozzle 111 toward the object to be coated 8 to always provide the stable airflow state around the path 50 of the droplet L, the supply nozzles 501,502 follow the movement of the ejection head 11. The supply nozzles 501, 502 in the airflow supply mechanism 5 are preferably integrally formed with the ejection head 11 to follow the movement of the ejection head 11.

In the coating process according to the third embodiment, the droplet L is ejected from the ejection nozzle 111 to coat the object to be coated 8 while the airflows 51, 52 are supplied along the traveling direction D1 of the droplet L from near the ejection nozzle 111 toward the object to be coated 8.

Through the above coating process, the object to be coated 8 is manufactured.

The coating process can be performed while the airflows 51, 52 are supplied to the opposite sides of the path 50 of the droplet L described in the third embodiment, and also the solvent vapor contained in the ink is exhausted as described in the first or second embodiment.

Specifically, as described above, the droplet L may be ejected from the ejection nozzle 111 to coat the object to be coated 8 while the air jet 31 is supplied around the target range 81 and within the region R1 of the cover 20 projected onto the object to be coated 8 and the airflows 51, 52 are supplied toward the object to be coated 8 along the traveling direction D1 of the droplet L from near the ejection nozzle 111 configured to eject the droplet L to the object to be coated 8.

This allows the solvent vapor to be exhausted from the coated film while reducing an influence on flying of the droplet and ensuring drawing quality.

The ejection head 11 is driven by the X direction drive portion 14X of the drive mechanism 14 (FIG. 2) and moved in the X direction relative to the object to be coated 8 to eject the droplet L from the ejection nozzle 111 in the axial direction (Z direction) of the channel of the ejection nozzle 111.

FIG. 14A shows an example of a process of flying of a single droplet L along the traveling direction D1 from immediately after the droplet L is ejected from the ejection nozzle 111 to when the droplet L lands on the surface of the object to be coated 8.

Figure 14B:
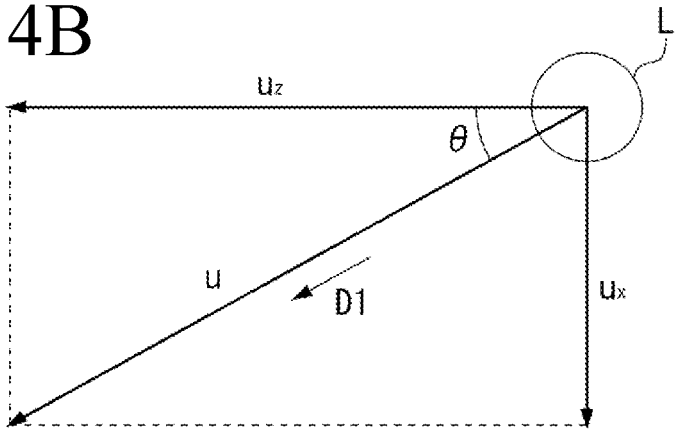

As shown in FIG. 14B, a speed u of movement of the droplet L toward the object to be coated 8 corresponds to a resultant vector of an initial speed $u_z$ of a movement speed of the droplet L in the Z direction (first direction) immediately after being ejected from the ejection nozzle 111, and a movement speed $u_x$ of the ejection head 11 in the X direction (second direction) when the droplet L is ejected from the ejection nozzle 111.

An angle θ formed between a vector of the speed u of movement of the droplet L and a vector of the initial speed $u_z$ in the Z direction is expressed by the following equation:

$$\theta = \tan^{-1}\left(\frac{u_x}{u_z}\right) \quad \text{[Formula 2]}$$

The angle θ that determines the traveling direction D1 of the droplet L changes depending on the movement speed $u_x$ of the ejection head 11 and the initial speed $u_z$. Thus, the airflow supply mechanism 5 is preferably configured to be able to change the directions of the airflows 51, 52 based on the movement speed $u_x$ and the initial speed $u_z$.

For example, the directions of the supply nozzles 501, 502 can be changed depending on the movement speed $u_x$ of the ejection head 11 to keep the directions of the airflows 51, 52 along the traveling direction D1 of the droplet L.

According to the inkjet ejection device and the coating method of the third embodiment described above, the airflows 51, 52 are supplied toward the object to be coated 8 along the traveling direction D1 of the droplet L from near the ejection nozzle 111 configured to eject the droplet L, thereby providing a stable airflow state around the path 50 of the droplet L. This can reduce an influence of a flow of ambient atmosphere caused by the air from the exhauster for discharging the solvent vapor or the movement of the ejection head 11 on flying of the ink droplet L, and ensure drawing quality.

Other than the above, the configurations in the embodiments may be chosen or changed to other configurations without departing from the gist of the present invention.

REFERENCE SIGNS LIST

2, 2A, 2B exhaust device
5 airflow supply mechanism
8, 8A object to be coated
9 support device
10 inkjet ejection device
11 ejection head (inkjet head)
11A supply channel
12 ink tank
13 head device
14 drive mechanism
14X X direction drive portion
14Y Y direction drive portion
15 frame
16 base
17 column
20 cover
23 external communication opening (external communication portion)
24 compartment
25 enclosure
30, 30A air blow mechanism
31, 31A jet
32 supply duct
33 jet nozzle
40 exhaust mechanism
41 exhaust duct
42 exhauster
43 discharge duct

44 cleaning device
50 path
51, 52 airflow
53 gap
60 closing member
61 side wall
62 seal member
81, 81A, 81B, 81C target range
82 coated film
91 receiving member
110 ink chamber
111 ejection nozzle
111A inlet
111B introduction channel
111C ejection channel
112 pin
113 actuator
114 valve
151 horizontal member
152 vertical member
153 reinforcement
161 wheel
242 compartment
241 to 243 small compartment
321 to 324 duct
325, 326 dividing duct
411, 412 exhaust duct
501, 502 supply nozzle
821 solvent vapor
D1 traveling direction
L droplet
R1 projected region
u droplet movement speed
$u_x$ head movement speed
$u_z$ initial speed
θ angle

What is claimed is:

1. An exhaust device for inkjet coating comprising:
a cover that covers at least a target range on an object to be coated, the target range being a range in which a droplet lands that is ejected from an ejection nozzle of an inkjet head to a surface of the object to be coated;
a closing member that closes a gap between the cover and the object to be coated around the target range;
an external communication portion through which a compartment surrounded by the cover, the object to be coated, and the closing member communicates with an outside; and
an exhaust mechanism configured to exhaust air from the compartment, wherein
the closing member comprises:
a side wall rising from an edge of the cover toward the object to be coated; and
a seal member disposed on the side wall and in contact with the object to be coated.

2. The exhaust device for inkjet coating according to claim 1, further comprising:
an air blow mechanism configured to supply an air jet around the target range and within a region of the cover projected onto the object to be coated; and
a compartment surrounded by the cover, the object to be coated, and the jet.

3. The exhaust device for inkjet coating according to claim 2, wherein the air blow mechanism supplies the jet from outside to inside the target range.

4. The exhaust device for inkjet coating according to claim 2, wherein
the air blow mechanism supplies the jet around and also into the target range to form a plurality of the compartments surrounded by the cover, the object to be coated, and the jet, and
the plurality of compartments each communicate with the outside of the compartments through external communication portions.

5. The exhaust device for inkjet coating according to claim 2, wherein the air blow mechanism includes
a supply duct into which air pressurized with respect to atmospheric pressure is introduced, and
a plurality of jet nozzles configured to discharge air in the supply duct to form the jet.

6. The exhaust device for inkjet coating according to claim 5, wherein the cover and the supply duct arranged at a peripheral edge on one surface of the cover constitute a box-like enclosure.

7. The exhaust device for inkjet coating according to claim 1, wherein the external communication portion is an opening extending through the cover.

8. The exhaust device for inkjet coating according to claim 1, wherein
the exhaust mechanism includes
an exhaust duct connected to the external communication portion, and
an exhauster configured to exhaust air from the compartment through the exhaust duct.

9. An inkjet ejection device comprising:
an inkjet head including an ejection nozzle configured to eject a droplet to an object to be coated, and
an airflow supply mechanism configured to supply an airflow along a traveling direction of the droplet from near the ejection nozzle toward the object to be coated, wherein
a supply nozzle included in the airflow supply mechanism is integrally formed with the inkjet head to follow movement of the inkjet head.

10. The inkjet ejection device according to claim 9, wherein the airflow supply mechanism supplies a pair of the airflows with a path of the droplet therebetween.

11. The inkjet ejection device according to claim 9, wherein the following equation is satisfied:

$$\theta = \tan^{-1}\left(\frac{u_x}{u_z}\right) \quad \text{[Formula 1]}$$

where
$u_z$ is an initial speed of the droplet immediately after being ejected from the ejection nozzle in a first direction,
$u_x$ is a speed of movement of the inkjet head in a second direction relative to the object to be coated, and
θ is an angle formed between a vector of a speed of movement of the droplet ejected from the ejection nozzle of the inkjet head moving in the second direction and a vector of the initial speed in the first direction, and
the airflow supply mechanism is configured to be able to change the direction of the airflow based on m and $u_z$.

12. The inkjet ejection device according to claim 10, wherein
the following equation is satisfied:

$$\theta = \tan^{-1}\left(\frac{u_x}{u_z}\right) \quad \text{[Formula 1]}$$

where $u_z$ is an initial speed of the droplet immediately after being ejected from the ejection nozzle in a first direction, $u_x$ is a speed of movement of the inkjet head in a second direction relative to the object to be coated, and $\theta$ is an angle formed between a vector of a speed of movement of the droplet ejected from the ejection nozzle of the inkjet head moving in the second direction and a vector of the initial speed in the first direction, and the airflow supply mechanism is configured to be able to change the direction of the airflow based on $u_x$ and $u_z$.

13. An inkjet coating method comprising the steps of:

covering at least a target range on an object to be coated with a cover, the target range being a range in which a droplet lands that is ejected from an ejection nozzle of an inkjet head to a surface of the object to be coated;

closing a gap between the cover and the object to be coated around the target range with a seal member disposed on a side wall rising on an end of a closing member toward the object to be coated;

exhausting air from a compartment surrounded by the cover, the object to be coated, and the closing member while causing the compartment to communicate with an outside of the cover; and ejecting the droplet from the ejection nozzle to coat the object to be coated.

14. The inkjet coating method according to claim 13, wherein the object to be coated constitutes an airframe of an aircraft.

* * * * *